US011828170B2

(12) United States Patent
Elliott et al.

(10) Patent No.: US 11,828,170 B2
(45) **Date of Patent: *Nov. 28, 2023**

(54) METHOD FOR COMMUNICATING ELECTRICAL SIGNALS IN A WELL

(71) Applicant: Expro North Sea Limited, Aberdeen (GB)

(72) Inventors: David Robert Elliott, Poole (GB); Stephen James Beale, Weymouth (GB); Thomas Lempriere Searight, Devizes (GB); Christopher Lambert, Swindon (GB)

(73) Assignee: EXPRO NORTH SEA LIMITED, Aberdeensh (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,170

(22) Filed: Sep. 29, 2021

(65) Prior Publication Data

US 2022/0018246 A1 Jan. 20, 2022

Related U.S. Application Data

(62) Division of application No. 16/761,125, filed as application No. PCT/GB2018/053129 on Oct. 30, 2018.

(30) Foreign Application Priority Data

Nov. 3, 2017 (GB) ..... 1718255

(51) Int. Cl.
*E21B 47/13* (2012.01)
*E21B 17/10* (2006.01)

(52) U.S. Cl.
CPC ..... *E21B 47/13* (2020.05); *E21B 17/1021* (2013.01)

(58) Field of Classification Search
CPC ..... G01V 3/00; E21B 47/113; E21B 17/1021; E21B 47/0025
See application file for complete search history.

(56) References Cited

U.S. PATENT DOCUMENTS

| | | | | |
|---|---|---|---|---|
| 3,379,964 | A * | 4/1968 | Segesman | G01V 3/20 324/374 |
| 4,289,025 | A | 9/1981 | Norel | |
| 5,680,049 | A * | 10/1997 | Gissler | E21B 23/14 324/371 |
| 10,254,432 | B2 * | 4/2019 | Cuevas | G01V 3/34 |
| 2011/0297366 | A1 | 12/2011 | Wittle | |
| 2012/0131996 | A1 | 5/2012 | Anish | |
| 2015/0267530 | A1 | 9/2015 | Hudson | |
| 2018/0003850 | A1 | 1/2018 | Jaaskelainen | |
| 2019/0063214 | A1 * | 2/2019 | Castillo | E21B 17/1057 |

FOREIGN PATENT DOCUMENTS

WO 2015105505 A1 7/2015

* cited by examiner

*Primary Examiner* — Tara Schimpf
*Assistant Examiner* — Theodore N Yao
(74) *Attorney, Agent, or Firm* — GETZ BALICH LLC

(57) ABSTRACT

There are described devices and methods for use, for example, with signaling in a well, e.g. using a well structure of the well. Such signaling may include the communication of power and/or data signals. The devices and methods used may assist with efficient and/or effective communication of such signals. In some examples, there is described deployable devices and methods, e.g. a deployable device for signaling contact in a well, and methods associated therewith.

6 Claims, 7 Drawing Sheets

METHOD FOR COMMUNICATING ELECTRICAL SIGNALS IN A WELL

BACKGROUND OF THE INVENTION

This application is a divisional of U.S. patent application Ser. No. 16/761,125 filed May 1, 2020, which is a national stage application of PCT Patent Appin. No. PCT/GB2018/053129 filed Oct. 30, 2018, which claims priority GB Patent Appin. No. 1718255.1 filed Nov. 3, 2017, which are herein incorporated by reference.

TECHNICAL FIELD

Described examples relate to deployable devices, such as deployable contact devices, including those that may be used for signalling contact, and methods of use within a well.

BACKGROUND INFORMATION

Signaling within a well can be used to communicate data and/or power from one location at the well to another, for example communicate data and/or power from surface to a location downhole.

One method of communicating power and/or data signals downhole comprises using the metallic well structure itself as part of the signal path. In other words, the metallic tubing within the well may be used not only for structural reasons, but may also serve as a communication path for signals, such as electrical signals (e.g. EM signals).

Communicating in this manner presents a number of technical challenges, such as managing signal attenuation or noise ratios. There is a continuing need to improve the ability with which to communicate signals in a well, in particular EM signals that may use the metallic well structure for some or all of the signal path.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

There are described devices and methods for use, for example, with signaling in a well, e.g. using a well structure of the well. Such signaling may include the communication of power and/or data signals. The devices and methods used may assist with efficient and/or effective communication of such signals.

In some examples, there is described deployable devices and methods, e.g. a deployable device for signaling contact in a well, and methods associated therewith.

Such devices may comprise a body portion. The device, and indeed the body portion, may be configured for deployment in a well bore, e.g. the body portion may be considered to be an elongated body portion.

Such devices may comprise a mounting arrangement, which may be configured to retain the device at a location at a well structure (e.g. retained at a desired location). For example, the mounting arrangement may be configured to engage mechanically with a wall surface of that well structure. The wall surface may be in inner bore wall of the well structure. In particular, the mounting arrangement may be controllably deployable from the body portion. In other similar words, the device may be configured such that the mounting arrangement is deployable upon a controlled activation. The mounting arrangement may comprise conductive pads to provide signaling continuity between engaged well structure and the mounting arrangement. The pads may be electrically conductive pads to provide electrical continuity for signaling purposes. Additionally, or alternatively, the pads may be acoustically conductive pads to provide acoustic continuity for signaling purposes (e.g. the pads may be configured to be impedance matched with an expected well structure, or the like).

In some examples, the device may be configured such that there is provided a signal path between one or more of the conductive pads and the body portion so as to provide signaling continuity between well structure and body portion, when deployed.

The body portion may comprise one or more connection points electrically connecting the device to further apparatus for further signaling therefrom. So, for example, the signal path may be provided between the conductive pads and the connection point(s) so as to allow for signaling continuity between well structure and further apparatus (e.g. further tools, devices, e-lines, etc. connected to the device at the connection point). In some examples, the device may comprise a plurality of connection points. Each connection point may be provided at a common potential. Some or all connection points may be selectable (e.g. by the device) in order to direct signals to one or more apparatus attached at particular connections points.

In some particular examples, the device may be configured, during deployment, to abrade a wall surface of a well structure. In other similar words, the device may be configured to specifically scrub a wall of the well structure during deployment. In such a way, the device may be configured to liberate or displace built-up coatings or detritus at the wall of the well structure. Doing so may provide signaling continuity, such as improved electrical continuity, between that engaged well structure and the mounting arrangement (e.g. compared to merely making mechanical contact with a wall of well structure).

In some cases, the conductive pads may comprise a contact surface, which may be configured to engage and abrade a wall surface, when deployed. For example, the contact surface may comprise a plurality of serrations or the like, configured to engage with and abrade a wall surface.

The mounting arrangement may comprise deployment arms (e.g. a plurality of deployment arms). The deployment arms may be regularly spaced around the device (e.g. at 30, 45, 60, 90, 120, or 180 degree intervals). The deployment arms may have a stowed configuration (e.g. for running into the well, and possibly retrieving from the well). In a deployed configuration, the deployment arms may extend from the body portion so as to urge the conductive pads into contact with a well structure.

The deployment arms may be rotatably attached to the conductive pads at a linkage region. In some examples, some or all of the deployment arms may comprise a contact surface for contact with a wall surface. The contact surface may be specifically configured for contact with a wall surface of a well structure, when deployed. In some cases, the contact surface may be provided at the linkage region.

The contact surface of the deployment arms may comprise a plurality of serrations, or the like, configured to engage with and abrade a wall surface.

The device, or indeed the mounting arrangement, may be configured such that, rotation of the arms relative to the conductive pads, causes counteraction of the contact surfaces of the conductive pads and of the deployment arms at a wall surface of a well structure. Such counteraction of contact surfaces may assist with abrading that wall surface in use.

In some examples, the deployment arms may comprise a connection element, e.g. to provide a signaling connection to the body portion. The connection element may be configured to orbit and maintain signaling connection with a socket arrangement of the body portion. In such a way, when the arms are controllably moved between the stowed and deployed configuration, the connection element may maintain signaling continuity with the body portion, and so maintain the signal path from the deployment arms and the body portion. In that, and other ways, the device may be configured such that the signal path can be provided from the mounting arrangement to the body portion via the socket arrangement.

In described examples, the deployment arms may be rotatably connected to the body portion via a compliant connection. The compliant connection may assist with maintaining signaling continuity between the deployment arms and the body portion.

In some cases, the mounting arrangement may be controllably deployable from the body portion using a drive unit. In some examples, such a drive unit may be operable to deploy and subsequently retract the mounting arrangement, in use. The drive unit may be configured to be operable to deploy and subsequently retract the mounting arrangement, and then further deploy the mounting arrangement. Such re-deployment may assist with repositioning the device in a well, and/or may assist with abrading a wall surface of a well structure, e.g. at a particular location.

The drive unit may comprise a lead screw arrangement configured to deploy and retract the mounting arrangement. The drive unit may be packaged within the body portion of the device. While of course the drive unit may be powered by a number of different means (e.g. hydraulically), in some cases the device may comprise a battery unit for powering the drive unit. Such a battery unit may be being configured to be chargeable from signals (e.g. electrical signals) being communicated using the signal path.

The drive unit may be configured to deploy and/or retract the mounting arrangement using a pressure system. The pressure system may act against a piston, or the like, in order to move the mounting arrangement to the deployed/retracted configuration. In some examples, the pressure system may utilize well pressure to actuate the mounting arrangement (e.g. using a controllable valve, burst disc, etc. to permit well fluids to act upon a piston arrangement). In other examples, the pressure system may comprise a pressure reservoir configured to act upon a piston arrangement, or the like, when controlled to do so.

The device may be configured, in use, to couple with further apparatus so as to communicate signals to and/or from that further apparatus and well structure. The device may be configured to communicate data and/or power electrical signals to/from well structure.

In some examples, there is described a deployable string (e.g. a tool string). The string may comprise a contact device, as described above. In some examples, the string may comprise two or more such contact devices. The contact devices may be axially displaced from one another along the string. Such a deployable string may comprise one or more downhole gauges, casing collar locators, survey tools or other downhole tools.

In some cases, two or more of the contact devices may be independently operable in order to deploy and retain the string at a position in a well structure. In other similar words, each of the contact devices may be operable separately. This may permit controlled deployment of one device, and then the other device. For example, in some cases, the string may be configured for controlled sequential deployment of the devices.

Some described examples detail the use of devices or deployable strings described above.

In some examples, there is described a method for communicating signals, such as electrical and/or acoustic signals, in a well.

The method may comprise deploying a contact device to a location in well. The method may comprise controllably deploying a mounting arrangement of the device so as to mechanically, and in some examples electrically, engage with a wall surface of that well structure. The method may further comprise communicating electrical and/or acoustic signals to/from the well structure using a signal path formed between the device and the well structure, e.g. using the mounting arrangement.

In some examples, the method may comprise abrading the wall surface of a well structure so as to provide signaling continuity, or indeed improve continuity, between that engaged well structure and the mounting arrangement.

In some examples, and subsequent to engagement, the method may comprise assessing the continuity between the device and the well structure. The continuity between the device and the well structure may be assessed by measuring the impedance along the signal path, e.g. at the device/well structure.

The method may comprise controllably retracting and re-deploying the mounting arrangement in the event of an observed lack of continuity or an observed impedance beyond a threshold (e.g. an impedance variation beyond a predefined threshold). The method may comprise re-deploying the signaling contact device to a different location in the well, prior to re-deploying the mounting arrangement.

The method may comprise deploying two or more contact devices as part of a deployable string. In such examples, the method may comprise controllably deploying mounting arrangements of each of the devices so as to mechanically, and in some examples electrically, engage with a wall surface of that well structure. The method may comprise controllably retracting and re-deploying each mounting arrangements independently (or otherwise separately) in the event of an observed lack of continuity or an observed impedance beyond a threshold (e.g. an impedance indicting lack or poor electrical continuity, or otherwise an acoustic impedance mismatch beyond a threshold).

In some further examples, there is described a method of charging a battery unit downhole, such as a battery unit of a wellbore device (e.g. a movable device in a well bore). The device may be configured so as to be movable from a first location to second location within a well. The method may comprise controllably deploying a mounting arrangement of the device so as to mechanically and electrically engage with a wall surface of a metallic well structure; and communicating electrical signals from the well structure to a battery unit of the device using an electrical signal path formed between the device and the metallic well structure, e.g. via the mounting arrangement. In some examples, the method may include charging a battery unit of a further device positioned in the well. In those examples, electrical signals may be communicated from the well structure to a battery unit using an electrical signal path formed between the movable device and the metallic well structure, via the mounting arrangement, whereby the battery unit is in electrical communication with the movable device (e.g. the battery unit may be provided in a gauge or sensor unit, which may be electrically connected to the moveable device).

In some examples, there is provided a computer program product or computer file configured to at least partially (or fully) implement the device and methods as described above. In some examples, there is also provided a carrier medium comprising or encoding the computer program product or computer file. The program or file may be non-transitory. In some examples, there is also provided processing apparatus when programmed with the computer program product described. Some of the above examples may implement certain functionality by means of software, but also that functionality could equally be implemented solely in hardware (for example by means of one or more ASICs (application specific integrated circuit) or Field Programmable Gate Arrays (FPGAs)), or indeed by a mix of hardware and software (e.g. firmware). As such, the scope of the disclosure should not be interpreted as being limited only to being implemented in software or hardware.

The invention includes one or more corresponding aspects, embodiments or features in isolation or in various combinations whether or not specifically stated (including claimed) in that combination or in isolation. As will be appreciated, features associated with particular recited embodiments relating to devices may be equally appropriate as features of embodiments relating specifically to methods of operation or use, and vice versa.

It will be appreciated that one or more embodiments/aspects may assist with efficient and/or effective communication of signals in a well.

The above summary is intended to be merely exemplary and non-limiting.

BRIEF DESCRIPTION OF THE DRAWINGS

A description is now given, by way of example only, with reference to the accompanying drawings, in which.

DETAILED DESCRIPTION OF THE INVENTION

The following described examples relate to deployable devices and methods that may be used to assist with efficient and/or effective communication of signals in a well, such as electrical signals (e.g. EM signals). It will be appreciated that signaling can include the communication of data and/or power signals.

However, it will also be appreciated when considering the following description that some features described may be used to assist with positioning of devices or tools strings within the well. Further, while the following examples relate to communication using EM and metallic well structure as a signal path (or at least part of a signal path), it will be appreciated that in other examples additional, or alternative signal variants may be used (e.g. acoustic signals). A skilled reader will readily be able to implement the various embodiments accordingly.

Figure 1B:
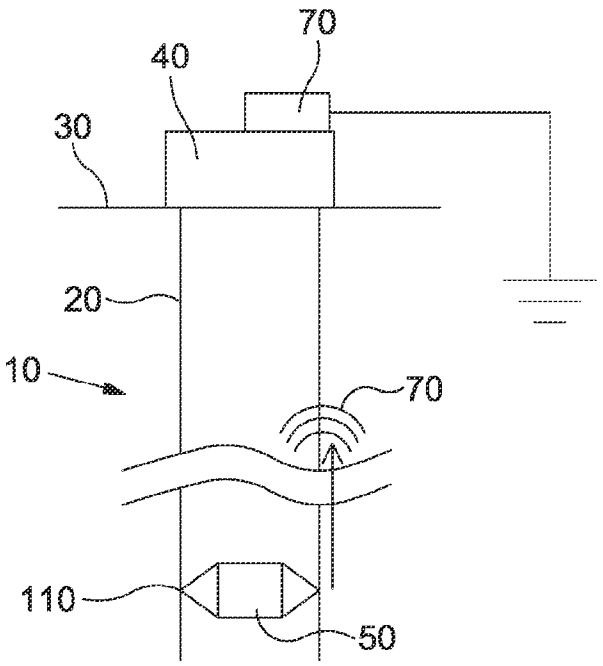
FIGS. 1A and 1B show examples of a device being deployed in a well.
Figure 1A:
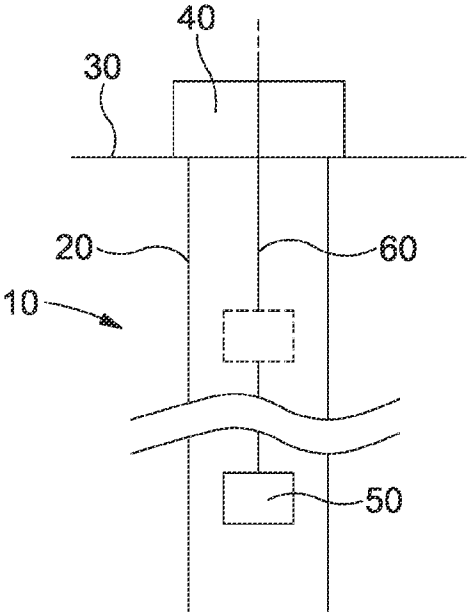

Consider now FIG. 1A, which shows a simplified representation of a section of a well 10, and in this case a production well 10. Here, metallic well structure 20 extends from the surface 30 to a subterranean formation, as will be appreciated. Of course, in other examples, the well 10 may be an appraisal well, injection well, or the like. Further still, the well 10 may be used for the production/injection of other fluids other than those in the oil and gas industry (e.g. water production).

In any event, in this example, such well structure 20 may include conductor, casing and other tubing used to recover product from the formation. Here, the well 10 comprises a wellhead 40, whether that may include a wet tree, dry tree or the like, at the surface 30. In some examples, of course, the wellhead/tree arrangement 40 may be provided at a production platform, for example having conductor extending to the seabed, as will be appreciated.

As shown in FIG. 1A, a device 50—and in this example a deployable electrical contact device 50—is being deployed in the well 10. In this case, the device 50 is being deployed using an elongated deployable medium 60, such as wireline, e-line, slickline, coiled tubing, or the like. While the wellhead 40 is shown in position, it will be appreciated that in some circumstances this may be modified, or indeed further equipment may be used (e.g. a lubricator), to assist with deploying the device 50 in the well 10.

Here, the device 50 comprises—or is otherwise in communication with—a sensor arrangement (not shown for ease), such as a gauge, configured to measure conditions at a well location. Such conditions may include pressures, temperatures, or the like.

As is shown in FIG. 1B, when positioned at a desired location in the well 10, a mounting arrangement 110 of the device 50 is controllably deployed so as to mechanically and electrically engage with a wall surface of that metallic well structure 20. As is shown in FIG. 1B, the mounting arrangement 110 mechanically engages with the inner wall of the well structure 20. When deployed, the device 50 is retained at that desired location in the well 10 using the mounting arrangement 110. Further, an electrical signal path is formed between the device 50 and the metallic well structure 20, using the mounting arrangement 110, as will be further described below. Data collected from the sensor arrangement can be communicated from that desired downhole location to a surface unit 70 by using the metallic well structure 20 as a signal path for signals (e.g. EM signals), in a manner provided commercially by the applicant. Similarly, signals can be communicated to the device 50 from surface.

Figure 2A:
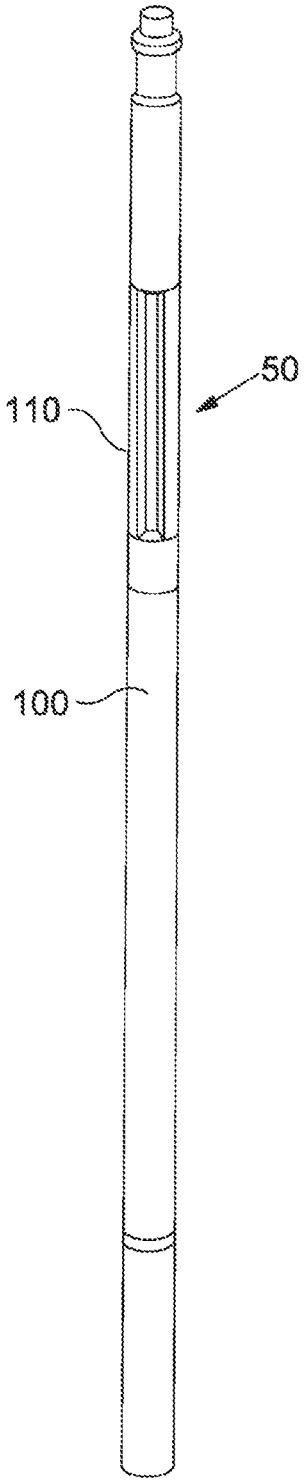
FIGS. 2A and 2B show the device of FIGS. 1A and 1B in more detail, in a stowed and deployed configuration respectively.
Figure 2B:
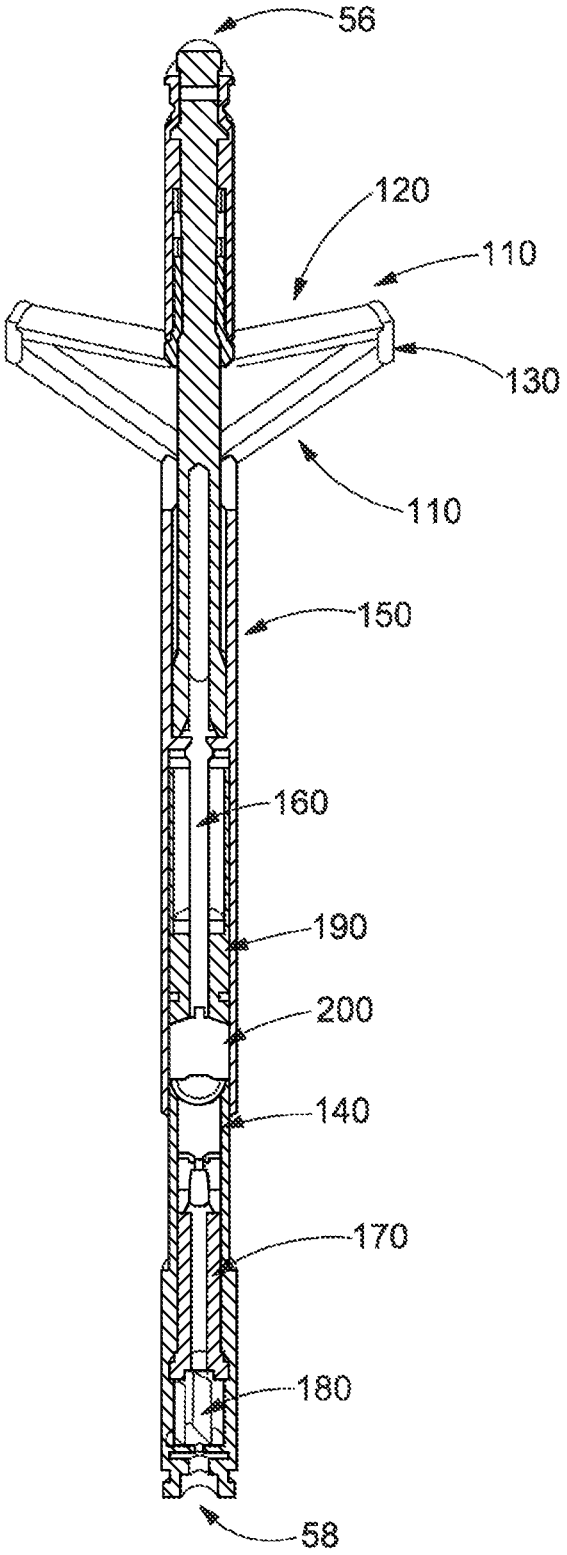

Consider now FIGS. 2A and 2B, which show the device 50 of FIGS. 1A and 1B in more detail. FIG. 2A shows the device 50 in a stowed configuration, e.g. when running to the well 20, whereas FIG. 2B shows a perspective representation of device 50, together with a cross-section, in a deployed configuration when configured to mechanically and electrically engage with a wall surface of the metallic well structure 20. Here, the device 50 comprises a body portion 100, which can be considered to be an elongated body portion for deployment in a well bore. The device 50 can be considered to have a proximal end 56 (nearer to surface) and a distal end 58 (further down in the well 20). The device 50 further comprises the mounting arrangement 110, described in relation to FIGS. 1A and 1B, and which will be described in further detail below.

The mounting arrangement 110 comprises a plurality of deployment arms 120, which have a stowed configuration (e.g. for running into the well 20) and a deployed configuration in which the deployment arms 120 extend from the body portion 100. Here, the device 50 comprises three deployment arms 120. In this case, the deployment arms 120 are regularly spaced around the device 50, or indeed around the body portion 100 of the device 50. In FIG. 2B, two deployment arms 120 are shown, which are orientated 30 degrees off from the cross-section. The third deployment arm is of course not shown.

The mounting arrangement 110 is controllably deployable from the body portion 100 using a drive unit 140. The drive unit 140 in this example is configured to actuate a sliding sleeve 150, which axially displaces along the body portion 100. Initially at least, the arms 120 are fixed at a position towards the proximal end 56 of the device 50, and free to move at a position towards the distal end 58 of the device, coupled to the sleeve 150. As such, and because the sleeve 150 is coupled with each of the deployment arms 120, axial displacement of the sleeve 150 along the body portion 100 causes each of the arms 120 to extend to the deployed configuration, or indeed retract, when the sleeve is moved axially in the alternative direction.

In this example, the drive unit 140 is operable to deploy and subsequently retract the mounting arrangement 110, in use. Here, the drive unit 140 comprises a lead screw arrangement 160, which acts with the sleeve 150, so as to deploy—and in this example retract—the mounting arrangement 110. The drive unit 140, as well as the lead screw arrangement, are essentially packaged within the body portion 100 of the device 50.

Of course, in other examples, the drive unit 140 may be configured to deploy and/or retract the mounting arrangement 110 using a pressure system. Such a pressure system may act against a piston, or the like, in order to move the mounting arrangement 110 to the deployed/retracted configuration. In some examples, the pressure system may utilize well pressure to actuate the mounting arrangement 110 (e.g. using a controllable valve, burst disc, etc. to permit well fluids to act upon a piston arrangement). In other examples, the pressure system may comprise a pressure reservoir configured to act upon a piston arrangement, or the like, when controlled to do so.

While of course the drive unit 140 and deployment/retraction of the mounting arrangement 110 may be powered by a number of different means (e.g. hydraulically), here the device 50 comprises a battery unit 170 for powering the drive unit 140. The battery unit 170 may additionally be configured to power any on-board circuitry 180, which may be used by the device for the purposes of signaling, sensing, etc. It will also be appreciated that in some examples, the battery unit 170 and any circuitry 180 may be provided separate or otherwise external to the device 50. For example, power and signaling may be provided from a sensor unit (e.g. gauge) connected to the device 50. In such a way, the component requirements of the device 50 itself may be minimized.

Figure 3:
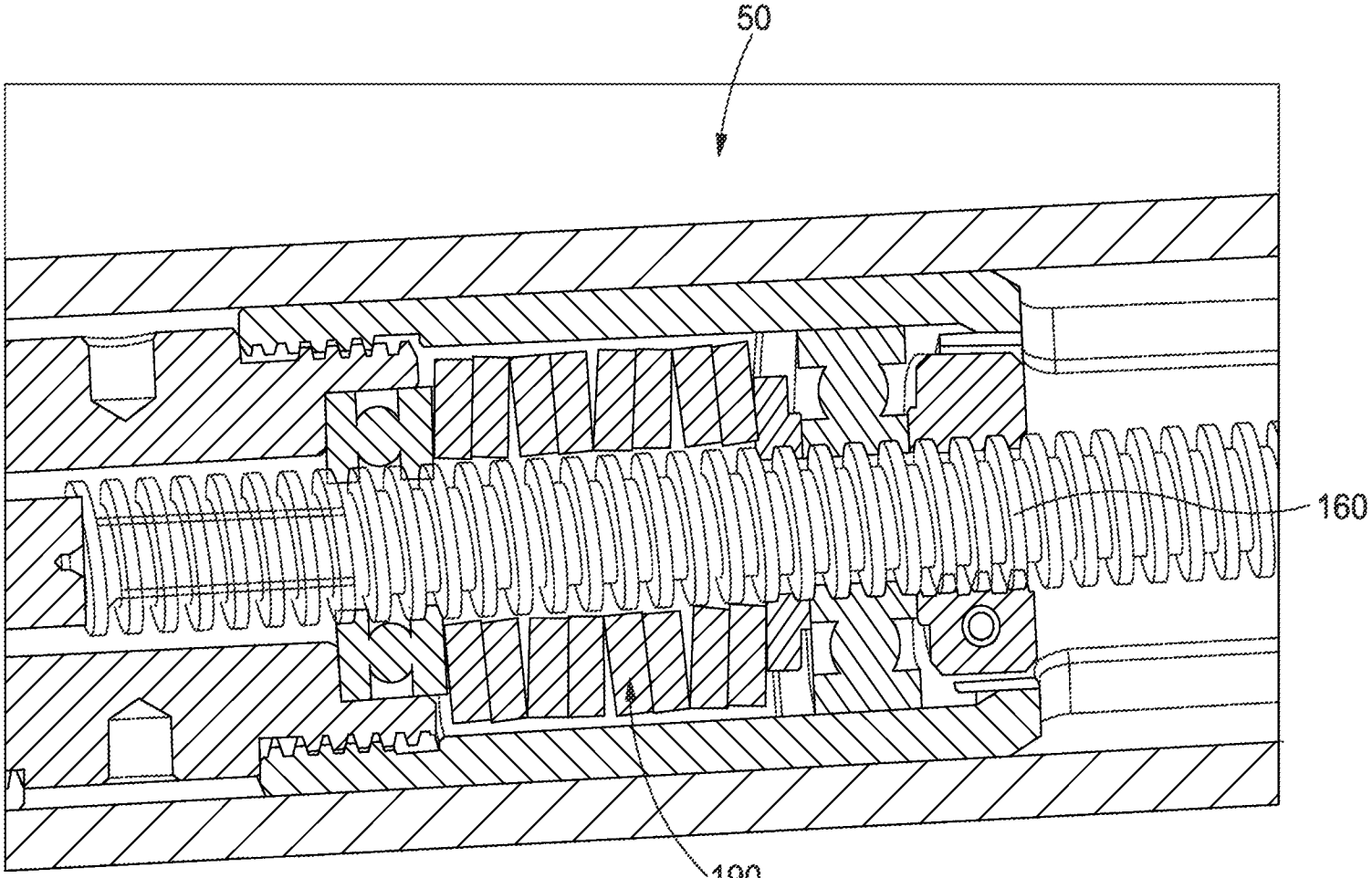
FIG. 3 shows a detailed section of a lead nut assembly of the device shown in FIG. 2B.

FIG. 3 shows in more detail the lead screw arrangement 160 together with a lead nut assembly 190. Here, the lead nut assembly 190 comprises a seal arrangement and compression spring arrangement (e.g. a Belleville arrangement). The lead nut assembly 190 here is configured to compensate for material changes due to temperature variation, or the like. As is shown in FIG. 2B, the drive unit 140 is configured to drive the lead screw arrangement 160, via a gearbox 200, which in this example is a reduction gearbox.

Figure 4B:
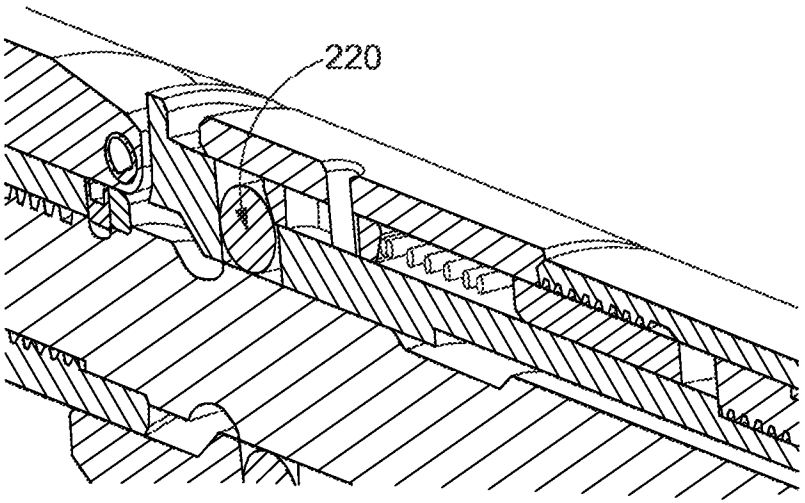
FIGS. 4A and 4B show a cross-section of a release mechanism of the device shown in FIG. 2B.
Figure 4A:
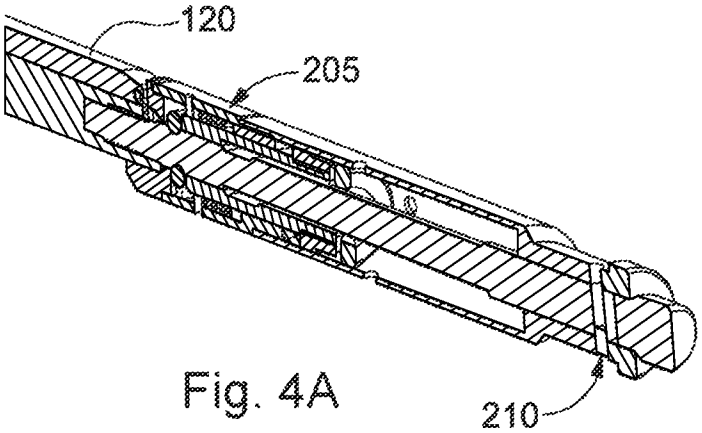

FIGS. 4A and 4B shows a cross-sectional view of the proximal end 56 of the device 50. As mentioned above, and as shown in FIG. 4A, initially at least, the deployment arms 120 are fixed towards the proximal end 56 of the device 50. In such a manner, as the sleeve 150 is actuated, the deployment arms 120 react from that fixed point, and cause radially outward displacement as is shown in FIG. 2B.

In this example (but not all), the device 50 further comprises a release mechanism 205 for releasing the deployment arms 120 from their deployed configuration (e.g. in the event of lack of control of or power to the drive unit). Here, the release mechanism 205 operates together with a releasable member 210, which in this example is provided as a shear pin (other releasable members may be used). In use, an upward overpull action at the proximal end 56 of the device 50 can actuate the releasable member 210, and activate the release mechanism 205 to permit axial movement of the (previously) fixed arms 120. In other examples, the device 50 may be configured such that a jarring action may be used. In such a manner, if need be, the device 50 and arms 120 can be retracted from their deployed configuration and permit retrieval to surface 30.

Figure 5A:
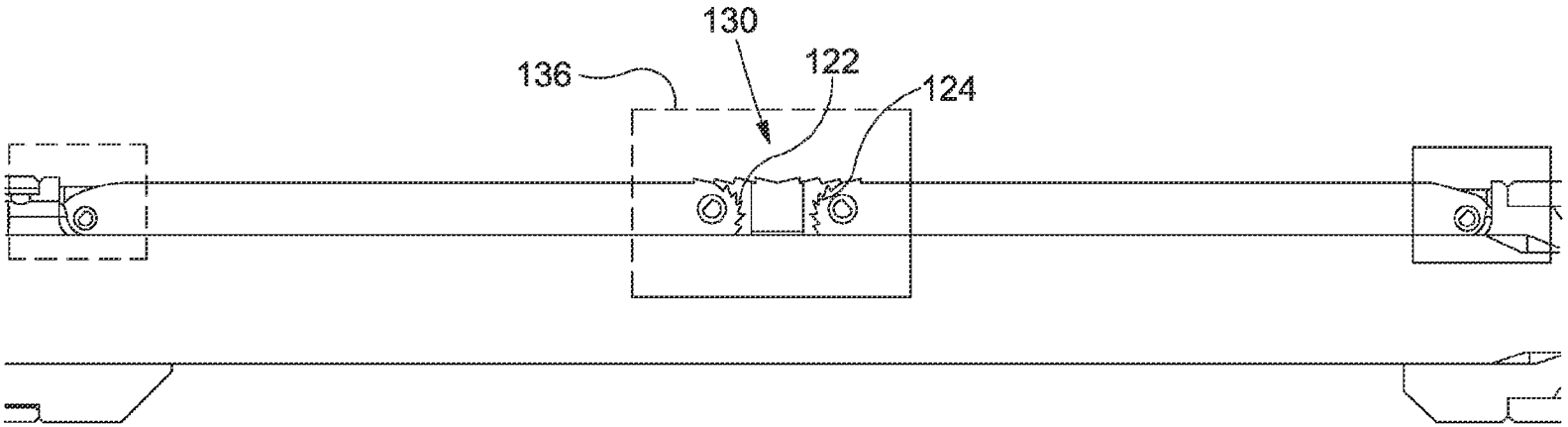
FIGS. 5A, 5B and 5C show further detail of a mounting arrangement of the device as shown in FIGS. 2A and 2B.
Figure 5C:
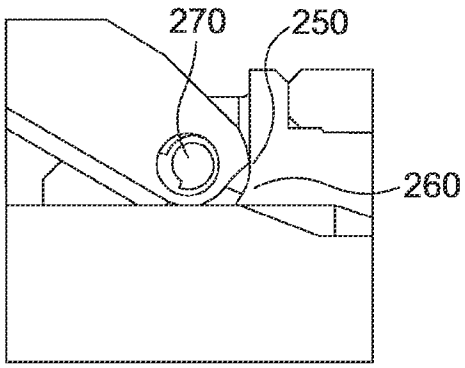
Figure 5B:
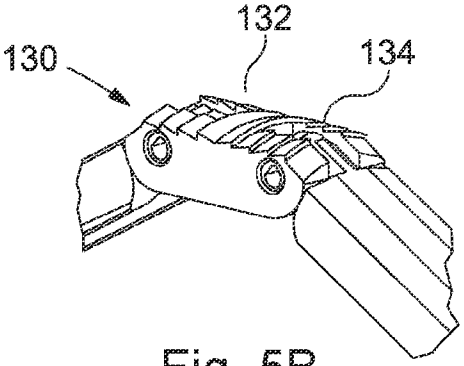

Consider now FIGS. 5A, 5B and 5C, which show features of the mounting arrangements 110 in more detail. In FIG. 5A, the mounting arrangement 110 in shown in the stowed configuration in which the deployment arms 120 are essentially flush with the body portion 100 of the device 50. As is also shown, the mounting arrangement 110 further comprises electrically conductive pads 130. Here, the pads 130 are configured not only to engage mechanically a wall of the well structure 20, but also to provide electrical continuity between engaged metallic well structure 20 and the mounting arrangement 110, as will be further described. In this example, each of the deployment arms 120 is in communication with a conductive pad 130. Each of the conductive pads 130 can be considered to comprise a contact surface 132, which is configured to engage a wall surface, when deployed. In addition, and as will further be described, the device 50—and in particular the mounting arrangement 110—is specifically configured to abrade a wall surface, when deployed. Here, the contact surface 132 of the conductive pads comprise a plurality of serrations 134 or the like, configured to engage with and abrade a wall surface.

Additionally, the deployment arms 120 are rotatably attached to the conductive pads 130 at a linkage region 136. FIG. 5B shows a perspective representation of the linkage region 136, when the deployment arms 120 and pads 130 are in a deployed configuration. As can be seen in FIGS. 5A and 5B, the deployment arms also comprise a contact surface 122 for contact with a wall surface. The contact surface 122 here is also specifically configured for contact with a wall surface of a metallic well structure, when deployed. Further, the contact surfaces 122 of the deployment arms 120 comprise a plurality of serrations 124, configured to engage with and abrade a wall surface.

In use, the device 50, or indeed the mounting arrangement 110, is configured such that, rotation of the arms 120 relative to the conductive pads 130, which occurs as the mounting arrangement is extended towards a wall, causes relative counteraction (e.g. counter rotation) of the contact surfaces 122, 132 of the conductive pads 130 and of the deployment arms 120 at a wall surface of a metallic well structure. Such relative counteraction of contact surfaces 122, 132 can assist with abrading that wall surface in use. In such a way, at the arms 120 and pads 130 are deployed at a surface, the surface can be scrubbed of debris, build up, corrosion or the like that may otherwise prevent or hinder a good signaling connection being made. Further, the arms 120 may in some examples be retracted and re-deployed in order to further ablate the wall surface.

While in some examples, a cable arrangement or the like may be used as part of the signal path from the pads 130 to the body portion 100, in other examples—as is the case here—the arms 120 themselves may form the signal path from the pads 130 to the body portion 100. As is shown in FIG. 5A and FIG. 5C, the deployment arms 120 further comprise a connection element 250, e.g. to provide signaling connection from the arms 120 to the body portion 100. As the arms 120 rotationally move with advancement and retraction of the sleeve 150 (when driven), the connection element 250 is configured to orbit and maintain signaling connection with a socket arrangement 260 of the body portion 100. In such a way, when the arms 120 are controllably moved between the stowed and deployed configuration, the connection element 250 may maintain continuity with the body portion 100, and so maintain the signal path from the deployment arms and the conductive pads 130 to the body portion. In that, and other ways, the device 50 can be configured such that the signal path can be provided from the mounting arrangement 110 to the body portion 100.

Here, to ensure that continuity is maintained over multiple deployments and retractions, and/or at different well conditions (e.g. differing temperatures), the deployment arms 120 are rotatably connected to the body portion 100 via a compliant connection 270. The compliant connection 270 can be used to permit some off-axially movement of the arms at the connection to the body portion 100. This can assist with maintaining signaling continuity between the deployment arms 120 and the body portion 100, and potentially avoid open circuits or poor communication at that point due to wear.

As such, in use, the mounting arrangement 110 can be configured to retain the device 50 at a location at a metallic well structure 20, for example, by mechanically engaging with a wall surface of that metallic well structure 20. Further, the mounting arrangement 110 may be controllably deployable from the body portion 100 such that the conductive pads provide electrical continuity between engaged metallic well structure 20 and the mounting arrangement 110. In doing so, the device 50 is configured such that there is provided an electrical signal path between the one or more of the conductive pads 130 and the body portion 100 so as to provide electrical continuity between metallic well structure 20 and body portion 100, when deployed.

Figure 6:
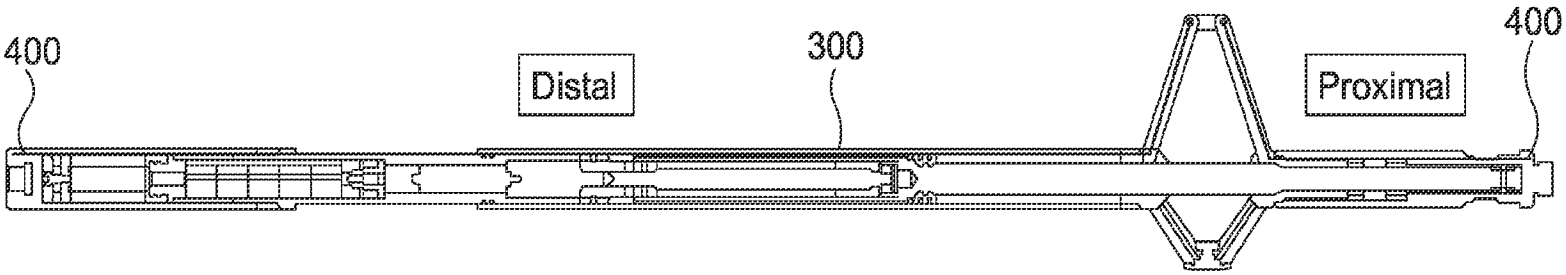
FIG. 6 shows an example of a signal path of the device.

FIG. 6 shows an example of the device 50 deployed in which an electrical signal path 300 is provided. In some examples, the body portion 100 may comprise a connection point 400 for electrically connecting the device 50 to further apparatus. So, for example, the electrical signal path 300 may be provided between the conductive pads 130 and the connection point 400 so as to allow for electrical continuity between metallic well structure 20 and further apparatus (e.g. further tools, devices, e-lines, etc. connected to the device 50 at the connection point 400). In some examples, the device 50 may comprise a plurality of connection points, as is shown in FIG. 6. Some or all connection points 400 may be selectable (e.g. by the device) in order to direct signals to one or more apparatus attached at particular connections points 400. In some examples, the battery unit 170 may be configured to be chargeable from electrical signals being communicated using the electrical signal path 300.

In use, the electrical contact device 50 can be initially deployed at a particular location in well, as mentioned in relation to FIG. 1A. Also, the mounting arrangement can be controllably deployed so as to mechanically and electrically engage with a wall surface of that metallic well structure 20. The deployment may be a timed deployment, or a pressure-based deployment, or controlled using signaling (e.g. via an e-line). After being at position, and electrically engaged, electrical signals can be communicated to/from the well structure using an electrical signal path 300 formed between the device 50 and the metallic well structure 20, e.g. using the mounting arrangement 110.

As mentioned, the due to the specific configuration of the device 50, the device 50 may be used to abrade the wall surface of a well structure 20 so as to provide signaling continuity between that engaged well structure 20 and the mounting arrangement 110.

In some examples and subsequent to engagement, the device 50 (or surface unit—not shown) may assess the continuity between the device 50 and the metallic well structure 20. The continuity between the device 50 and the metallic well structure 20 may be assessed by measuring the impedance along the electrical signal path 300 or the like, e.g. at the device/well structure. In the event of an observed lack of continuity or an observed electrical impedance beyond (e.g. above) a threshold (e.g. a predefined threshold), the device 50 may be configured to permit controllable retraction and re-deployment of the mounting arrangement 110. In doing so, the device 50 may be re-deployed to a different location in the well 10, prior to re-deploying the mounting arrangement 110, or indeed re-deployed at the same location in order to further ablate the wall surface.

It will be appreciated that in the above examples, the device 50 may be additionally or alternatively configured to communicate acoustic signals via the well structure. In doing so, the conductive pads 130 of the mounting arrangement 110 may provide acoustic continuity between engaged well structure and the mounting arrangement 110. For examples, the pads 130 and device 50 may be configured to provide an acoustic impedance match to the well structure 20 such that there is provided a signal path (in this example acoustic signal path) between one or more of the conductive pads 130 and the body portion 100. It will be appreciated that, as above, abrasion performed on a wall surface of the well structure 20 may improve acoustic continuity between that engaged well structure 20 and the mounting arrangement 110. Further, signals may be readily communicated from the body portion 100 to the well structure 20 (and vice versa) using the complaint connection 270, etc. as above. In some examples, the device 50 may comprise a signal receiver/transmitter (e.g. a transceiver) to communicate signals to/from the engaged well structure 20.

It will further be appreciated that in some examples, the device 50 may be configured, in use, to couple with further apparatus so as to communicate signals to and/or from that further apparatus and well structure 20, which can included data and/or power electrical signals to/from well structure 20. While the device 50 may be used alone, in other examples, the device 50 may be comprised with a deployable string (e.g. a tool string).

Figure 7B:
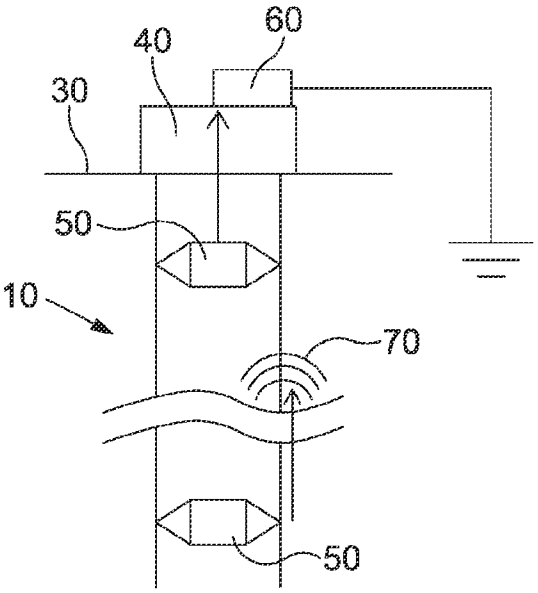
FIG. 7B shows a configuration in a well with multiple devices.
Figure 7A:
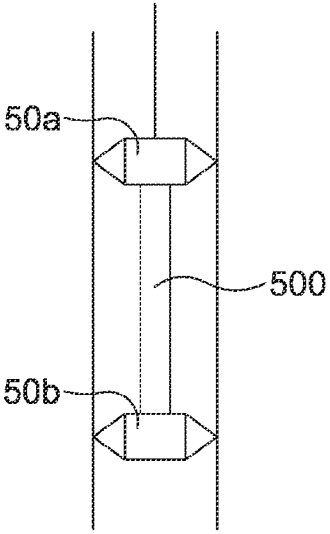
FIG. 7A shows a deployable string comprising devices as shown in FIGS. 2A and 2B.

FIG. 7A shows and example of a string 500 that comprises a contact device 50, as described above, and in this case the string 500 may comprise two or more such contact devices 50*a*, 50*b*. The contact devices 50*a*, 50*b* are axially displaced from one another along the string 500. Such a deployable string 500 may comprise one or more downhole gauges, casing collar locators or survey tools, or other such tools as may be desirable to use, or the like. When deployed, the device 50 may be used to support and maintain the string 500 at a particular location in the well.

Here, the two contact devices 50*a*, 50*b* are separately operable (e.g. independently operable) in order to deploy and retain the string 500 at a position in a well structure 20. In other similar words, the each of the contact devices 50*a*, 50*b* may be operable separately so as to be able to control deployment of one device 50*a*, and then the other device 50*b*. In doing so, one device 50*a* can initially be set, and hold the string 500, and then if need be the other can be deployed. In doing so, it may be possible to controllably retract and re-deploy each mounting arrangements 110 independently (or otherwise separately) in the event of an observed lack of continuity or an observed impedance beyond a threshold.

It will be appreciated also the multiple devices 50 may be set independently at different location in a well, as is shown in FIG. 7B. Here, one device 50 is positioned lower in the well, and communicates data to a second device at a higher location in the well. Signals can then be communicated to surface via a cable, or the like. Here, the devices may be positioned either side of a barrier, for example. In some examples, both electrical and acoustic signals may be communicated between the devices 550*a*, 50*b*.

It will be appreciated that in the above examples, it may be possible to charge devices or components of a deployable string 500 using signals. In such a way, the device 50 may be configured so as to be movable from a first location to second location within a well and be deployed so as to mechanically and electrically engage with a wall surface of that metallic well structure 20. Electrical signals can be communicated from the well structure 20 to the battery unit 170 of the device using an electrical signal path 300 formed between the device 50 and the metallic well structure 20, e.g. via the mounting arrangement 110. In such a way, the device 50 may be repeatedly reset, and redeployed. Further, the device 50 may be used to communicate power signals to battery units of further devices or apparatus in the well. So, for example, power signals may be communicated using the well structure, via a mounted device 50, to a battery unit of further apparatus (e.g. gauges, such as existing fixed gauges, or the like). Such further apparatus/battery units can therefore be external to the device 50, but nevertheless in electrical communication with the device 50 so as to communicate signals therewith.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the spirit and scope of the invention.

What is claimed is:

1. A method for communicating electrical signals in a metallic well structure, the method comprising:

deploying an electrical contact device to a location in the metallic well structure, the electrical contact device having a body and a mounting arrangement, the mounting arrangement including a plurality of deployment arm arrangements circumferentially spaced around the body, each deployment arm arrangement including a first deployment arm, a second deployment arm, and an electrically conductive pad having a contact surface with serrations;

wherein in each deployment arm arrangement a first end of the first deployment arm is rotatably attached to the body and a second end of the first deployment arm is rotatably attached directly to the electrically conductive pad, and a first end of the second deployment arm is rotatably attached to the body and a second end of the second deployment arm is rotatably attached directly to the electrically conductive pad, and each deployment arm arrangement is configured to establish a first electrical signal path between the electrically conductive pad and the body; and controllably deploying the mounting arrangement into a deployed configuration wherein the first deployment arm and second deployment arm of each respective deployment arm arrangement are rotated radially outward and the respective electrically conductive pad is translated radially outward causing the serrations of the contact surface to abrade the metallic well surface sufficiently to establish electrical continuity between the engaged metallic well structure and the mounting arrangement; and communicating electrical signals to and/or from the metallic well structure using a second electrical signal path formed between the electrical contact device and the metallic well structure, using the mounting arrangement.

2. The method according to claim 1 further comprising, subsequent to engagement, assessing an electrical continuity between the electrical contact device and the metallic well structure by measuring an electrical impedance along the second electrical signal path.

3. The method according to claim 2, further comprising controllably retracting and re-deploying the mounting arrangement in the event of an observed lack of said electrical continuity or an observed said electrical impedance beyond a threshold.

4. The method according to claim 3, further comprising re-deploying the electrical contact device to a different location in the metallic well surface, prior to re-deploying the mounting arrangement.

5. The method according to claim 1, wherein the method comprises deploying two or more said electrical contact devices as part of a deployable string, and controllably deploying said mounting arrangements of each of the electrical contact devices so as to establish electrical continuity between the engaged metallic well structure and the respective mounting arrangement.

6. The method according to claim 5, comprising controllably retracting and re-deploying the mounting arrangements of each electrical contact device independently in the event of an observed lack of an electrical continuity or an observed electrical impedance beyond a threshold.

* * * * *